US005207779A

United States Patent [19]

Chaplinski

[11] Patent Number: 5,207,779

[45] Date of Patent: May 4, 1993

[54] METHOD AND APPARATUS FOR CLOSING A WELLHEAD CASING

[76] Inventor: Charles Chaplinski, Rte. 1, Box 19, Middle River, Minn. 56737

[21] Appl. No.: 716,097

[22] Filed: Jun. 17, 1991

[51] Int. Cl.[5] ..... A62C 3/06

[52] U.S. Cl. ..... 169/43; 169/46; 169/48; 169/52; 169/69

[58] Field of Search ..... 169/69, 43, 46, 48, 169/52; 166/55, 297

[56] References Cited

U.S. PATENT DOCUMENTS 1,127,816 2/1915 Sink ..... 169/69 X

*Primary Examiner*—Charles A. Marmor

*Assistant Examiner*—Andrew C. Pike

*Attorney, Agent, or Firm*—D. L. Tschida

[57] ABSTRACT

A steerable compression clamp assembly includes a guide plate for aligning the assembly with an oil wellhead casing and clamp and compression assemblies for collapsing the casing to seal same. The clamp assembly provides an articulating arm which cooperates with a stop arm. The compression assembly includes a pair of crushing dies which mount to a hydraulic ram. In alternative configurations, a cable directed drag skid or a tracked vehicle support the compression assembly. Remotely mounted controls direct machine operation and steering. A hydraulic cylinder may also be included with a split duide plate to provide a controlled separation of the guide plate during compression.

14 Claims, 7 Drawing Sheets

METHOD AND APPARATUS FOR CLOSING A WELLHEAD CASING

BACKGROUND OF THE INVENTION

The present invention relates to devices for extinguishing oil well fires and, in particular, to a steerable assembly including means for collapsing the casing.

The inherent risk in owning and operating a producing oil well is the danger of a fire starting at the wellhead. Such fires are extremely difficult to extinguish due to the presence of high pressure flammable liquids and vapors which are emitted from the well. Even if temporarily extinguished, the high pressures can re-supply flammables to sustain the fire. That is, the presence of heated metal and other debris in the vicinity can exceed the flashpoint of the flammables and can restart a fire. The pressures also present difficulties in containing the flames, if attempting to cap the fire.

Further difficulties can arise depending upon the location of the rupture and type of rupture. The rupture may occur either above or below the ground and affect the ability to gain access. The rupture may also consist of a split verses a clean break. Debris or other devices, such as explosive mines, in the case of fires started in the aftermath of the Persian Gulf War, may also limit access. The manner of extinguishing a fire may therefore have to be adjusted to the prevailing circumstances.

One known method for fighting such fires is to explode explosives in close proximity to the source of the fire to evacuate the area of oxygen, upon detonation, and thereby extinguish the fire. Another method is to directly cap the wellhead in the manner of dousing a candle. Still another is to use refrigerants to reduce the flashpoint in proximity to the wellhead.

Otherwise, Applicant is unaware of any efforts directed to physically pinching-off the well casing and thereby separating the fuel source from the fire.

SUMMARY OF THE INVENTION

It is accordingly a primary object of the present invention to provide a method and an assembly for collapsing an oil wellhead casing upon itself to restrict all flow of liquid and gasses from the casing.

It is a further object of the invention to provide an assembly whereby the collapsed casing can be welded closed, immediately after being collapsed.

It is a further object of the invention to provide an assembly which is directable either by associated drag lines or is self-powered and can be remotely steered into alignment with a casing.

It is a further object of the invention to provide an assembly including guide means facilitating final alignment of a collapsing means with the casing.

It is a further object of the invention to provide an articulating clamp means to controllably secure the assembly to the casing and compression means which includes removeable dies.

Various of the foregoing objects, advantages, and distinctions of the invention are particularly achieved in one preferred construction which includes a split, slotted guide plate which is mounted to a drag cable directed skid frame. Pivotally secured to the guide plate is a hydraulic clamp assembly which includes first and second clamp arms. The first clamp arm includes a pair of articulating arm portions and a jaw assembly which mates with the second arm and a contained end stop. The arms expand to accept the casing and close to clamp the casing for compression. A pair of crushing or compression dies of a desired configuration are secured to the first arm and a hydraulic ram. The guide plate is also actuable to expand at an aft end during compression to accommodate casing expansion and permit the welding of the collapsed casing. In an alternative construction, the guide plate and compression arms are secured to a remotely directed, self-powered vehicle. In another construction, the compression assembly is used independent of the guide plate.

Still other objects, advantages and distinctions of the invention will become more apparent upon directing attention to the following description with respect to the appended drawings. The description is directed only to presently considered constructions and improvements or modifications to the invention and should not be strictly construed. Rather, the breadth of the invention should be interpreted from the appended claims.

DESCRIPTION OF THE PREFERRED EMBODIMENT

Figure 1:
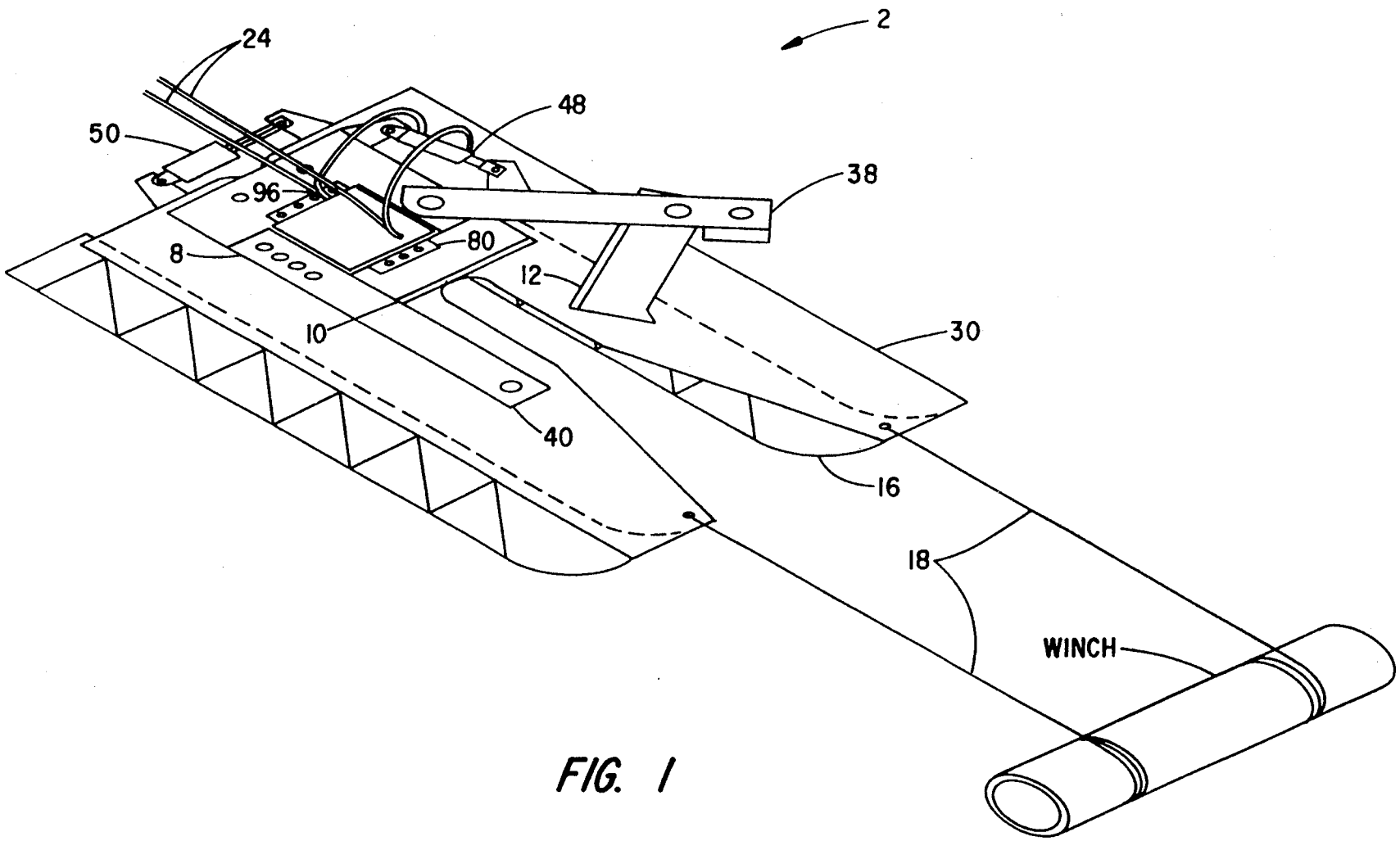
FIG. 1 is a generalized perspective drawing of a drag cable directed, skid mounted construction of the invention.
Figure 2:
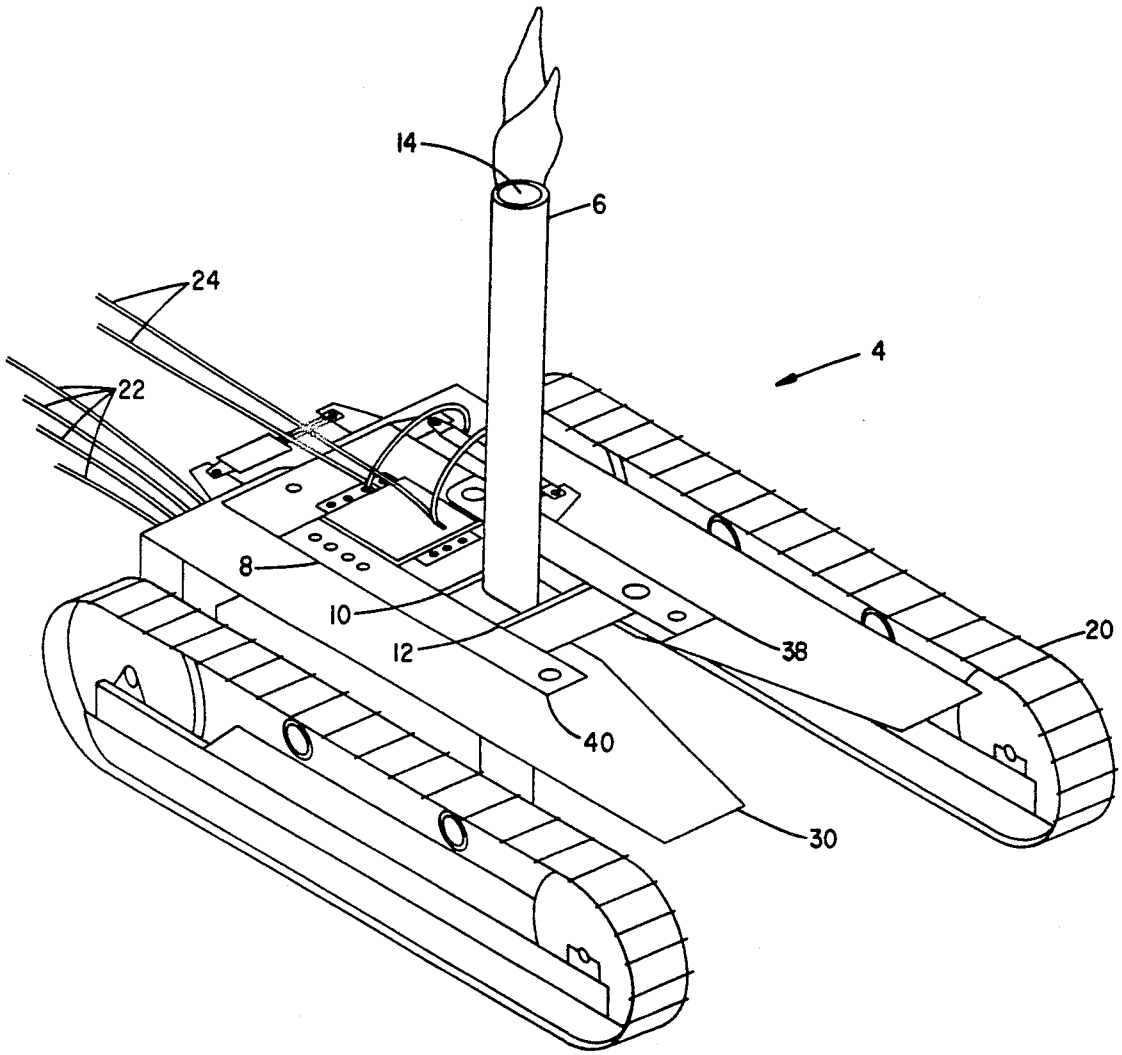
FIG. 2 is a generalized perspective drawing of a track vehicle which has been adapted to include the invention.

Referring to FIGS. 1 and 2, generalized perspective drawings are shown of assemblies 2 and 4 which find application for extinguishing fires at an oil wellhead casing. Either the assembly 2 of FIG. 1 or the assembly 4 of FIG. 2 can be directed under remote control into alignment with the casing 6 at a point beneath a casing rupture. Once aligned, each assembly 2 and 4 includes a compression means 8, which supports a pair of compression dies 10 and 12, to deform and compress the casing 6 to sealoff the casing bore 14. Once sealed, the bore 14 can be welded to assure a sustained closure.

The compression assembly 8 is operational, upon encircling the casing 6, to compress the casing 6 to prevent additional rupture or splitting of the casing as the sidewalls are collapsed. This end is achieved through the shaping of the dies. Under some circumstances, the casing 6 may be sequentially grasped and partially collapsed at a number of points along the casing, prior to effecting complete closure at an intermediate point.

FIG. 1 particularly depicts an assembly 2 which can be dragged into engagement with the casing 6, whereas FIG. 2 depicts an assembly 4 which can be remotely steered into engagement. The principal distinction is that a skid framework 16 and drag cables 18 are provided with the assembly of FIG. 1. The drag cables 18 mount to winch means (not shown). A remote operator independently controls each of the drag cables 18 via powered winch drums to direct the skid 16 and compression assembly 8 into abutment with the casing 6.

The assembly of FIG. 2, otherwise, provides a track vehicle 20 having a U-shaped chassis, such as manufactured by Ingersoll Rand Corporation for use in mining operations to support drill tools. The vehicle 20 is directable under remote control via hydraulic hosing 22 which are suitably reinforced and covered to prevent rupture under the anticipated working conditions and temperature in the range of 600 degrees Fahrenheit. Hoses 24 separately provide hydraulic fluids to the compression assembly 8 which is depicted as it appears when encircling the casing 6 and with the compression dies 10 and 12 contacting the casing 6. The hydraulic fluids are remotely directed through the hoses 22 and 24 from a controller 26 (reference FIG. 6) by an operator who is positioned at a safe location removed from the heat and flames, but yet positioned to view the alignment of the assembly 2 or 4 with the casing 6. Appropriate left and right steering and compression control are thereby obtained and the details of which will be described below with respect to FIG. 6.

Figure 3:
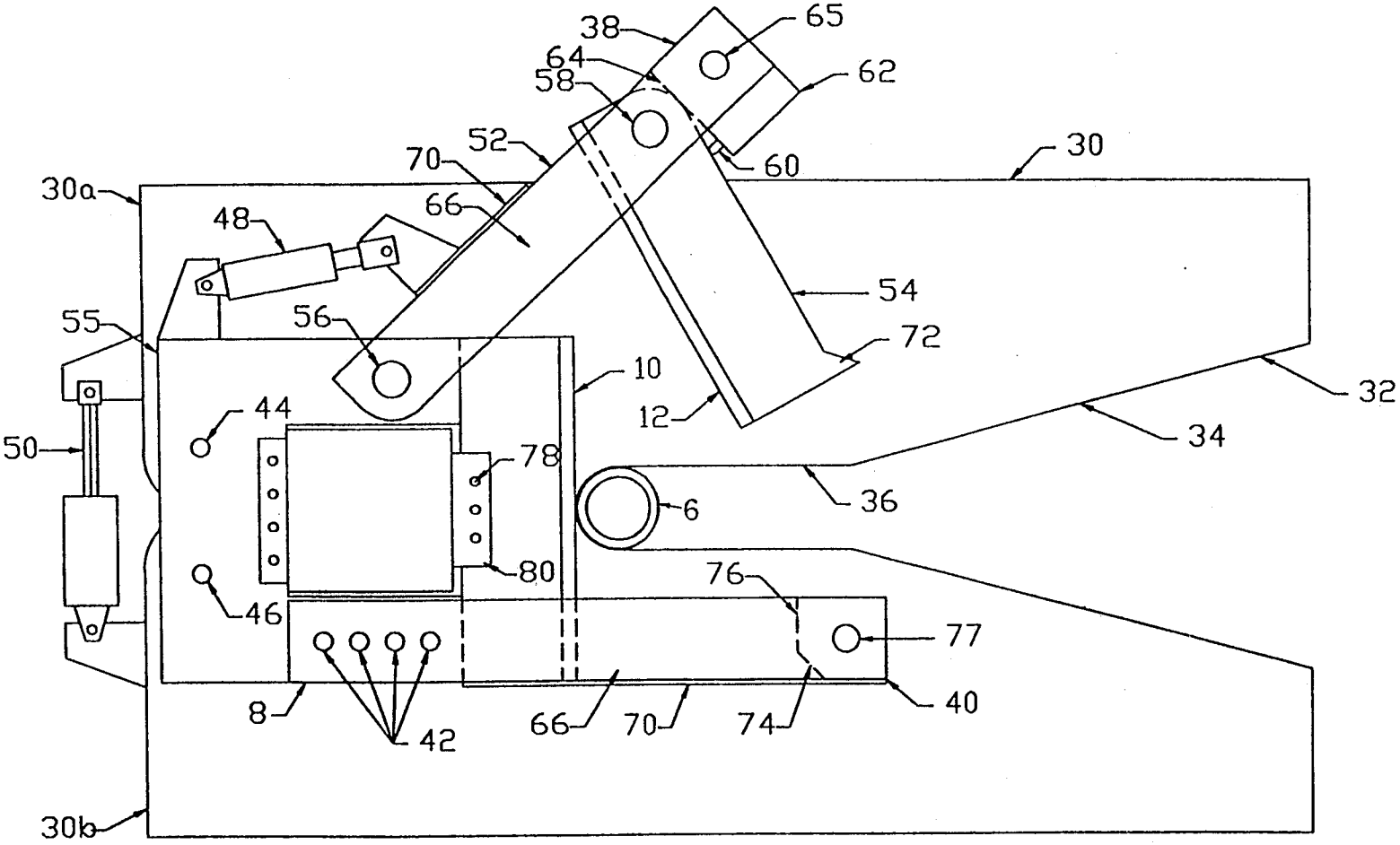
FIG. 3 shows a top plan view of an articulating compression assembly with the clamp arms shown in an open condition.

With further attention to FIG. 3, proper alignment with the casing 6 is obtained via a split, slotted guide-plate 30. The guide-plate is comprised of halves 30*a* and 30*b*. A longitudinal slot 32 provides an initial zone 34 which tapers inward to an aft zone 36 that terminates at the moveable compression die 10. The slot 32 provides not only a sighting aide for the operator, but the slot edges permit lateral adjustment of the assemblies 2 and 4 as the casing 6 is engaged. That is, the contact between the plate 30 with the casing 6, which is relatively stable and which typically provides an inside diameter on the order of seven to twelve inches and a wall thickness of one inch, laterally jogs the assembly 2 or 4 as it is moved forward. For exposed, aboveground ruptures, the track assembly 4 of FIG. 2 can be useful. If the rupture occurs underground, it may be necessary to trench an access space around the casing 6 via a drag bucket (not shown). In such circumstances, the drag cable assembly 2 provides advantages.

Regardless of the manner of engaging the casing 6, FIG. 3 discloses a detailed top plan view of the compression assembly 8 and wherein the clamp arms 38 and 40 are shown in a partially opened conditioned, see also FIG. 1. FIG. 2 depicts the compression assembly 8 in a closed clamp arm condition and wherein the compression dies 10 and 12 are shown as they appear after being drawn into engagement with the casing 6 and with the compression assembly 8 encircling the casing 6.

With particular attention to FIG. 3, the compression assembly 8 is secured along one edge to the guide-plate 30 with a number of appropriate bolt/nut fasteners 42 or via welding at appropriate points to prevent torsion of the compression assembly 8 during operation.

Figure 7:
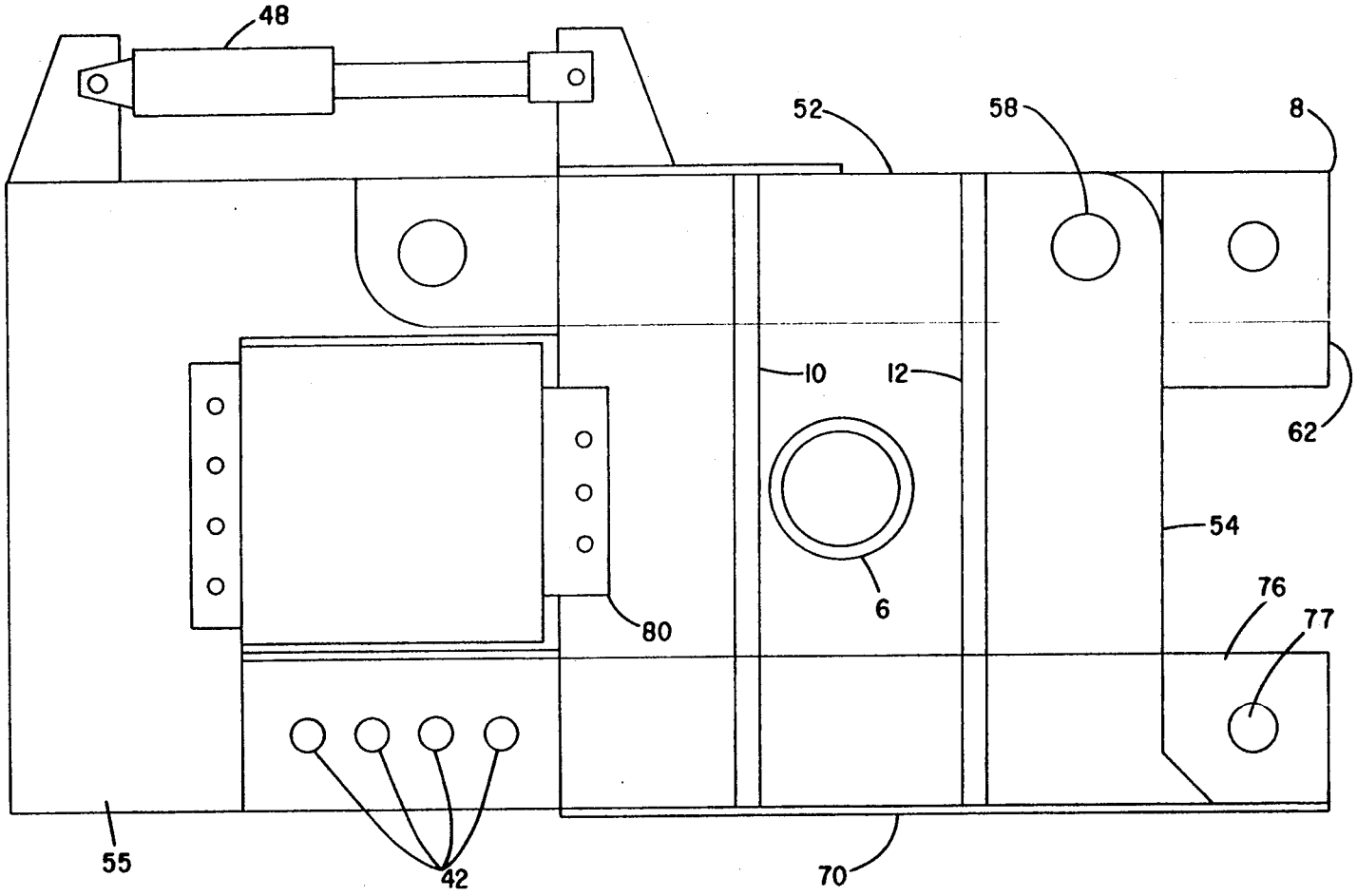
FIG. 7 is a top plan view of an alternative construction of the compression assembly without the guide plate and with the clamp arms shown in a closed condition.

The articulating clamp arm 38 is secured to the plate 30 at a first pivot pin 44 and the second, stationary clamp arm 40 is secured to the guide-plate 30 at a second pivot pin 46. A pair of hydraulic cylinders 48 and 50 are respectively coupled between the body 55 of the compression assembly 8 and between the aft ends of portions 30*a* and 30*b* of the guide-plate 30. The articulating and stationary clamp arms 38 and 40 are particularly secured to permit a controlled opening and closing of the guide-plate 30 with the collapsing of the casing 6 to accommodate the attendant lateral expansion of the casing 6. That is, as the casing walls are collapsed onto themselves in the fashion of FIG. 4, the walls expand laterally in the fashion of FIG. 5. This natural expansion and progressively increasing contact with the dies 10 and 12 requires that the guide-plate 30 expand in the region of the slot 32. Such motion is obtained with the actuation of the cylinder 50 which allows the casing to expand within the space between the arms 38 and 40. In lieu of using a guide-plate 30, FIG. 7 shows a construction wherein the guide-plate has been removed.

Figure 4:
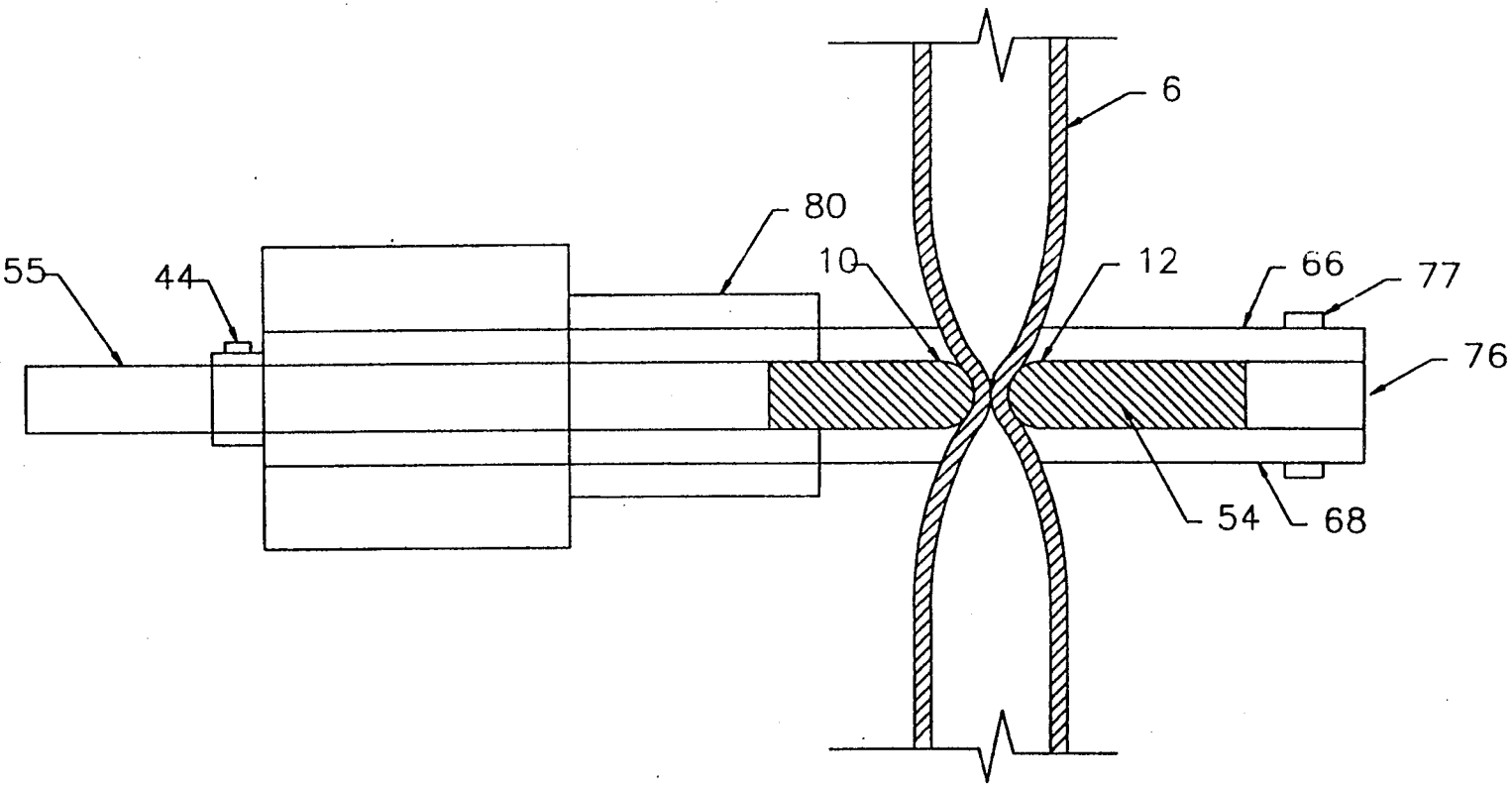
FIG. 4 depicts an illustrative transverse cross section view through the center of the region of the compression dies of FIG. 3, when viewed from the side and wherein the wellhead casing is shown collapsed.
Figure 5:
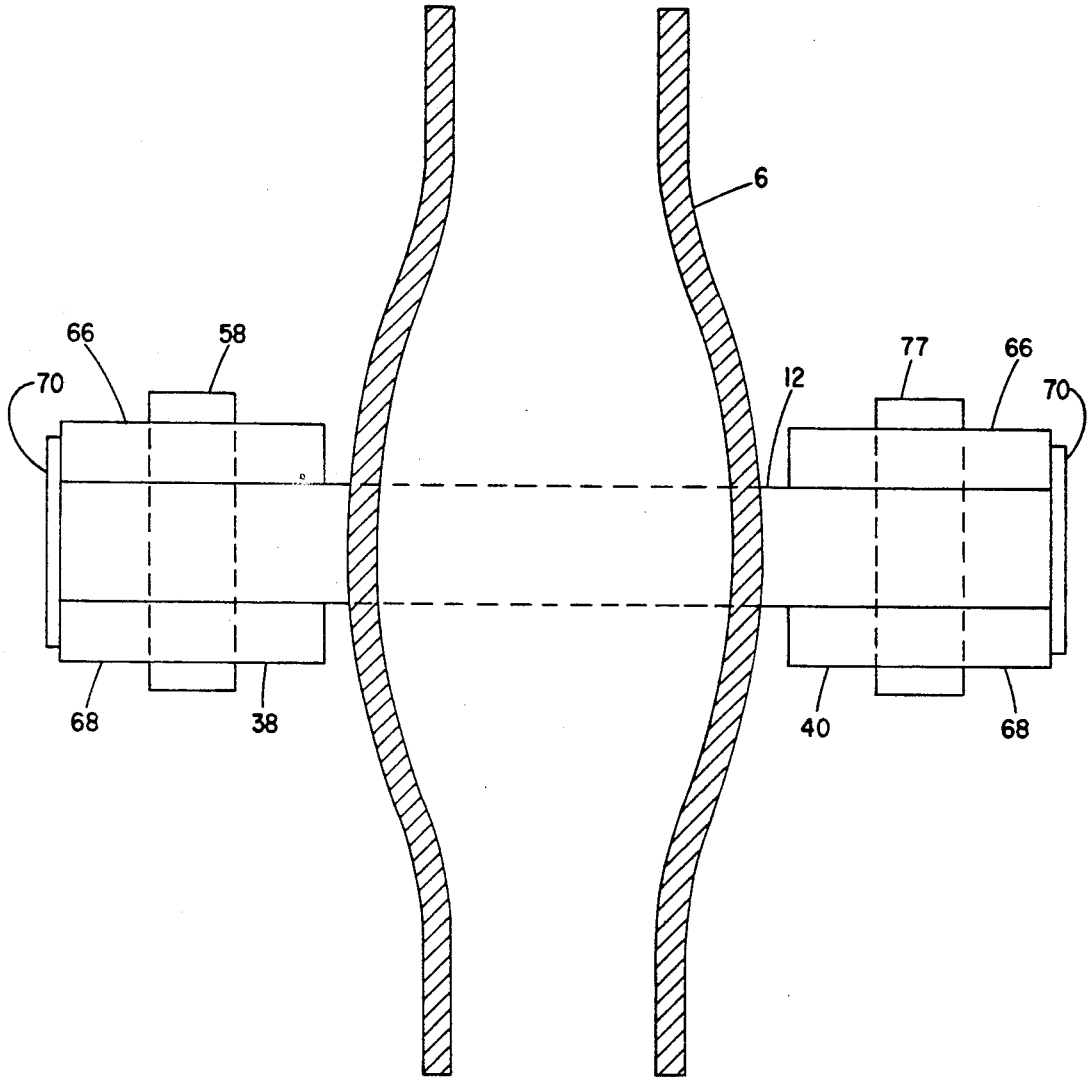
FIG. 5 depicts an illustrative longitudinal cross section view through the center of the region of the compression dies, similar to FIG. 4 but rotated ninety degrees.

Although FIGS. 4 and 5 depict one surface shape of the compression dies 10 and 12, it is to be appreciated that other surface shapes may be used to advantage. Some such shapes may induce partial compression at multiple points and eventual full compression as the casing walls collapse. As mentioned above, multiple partial compressions can also be performed in vertically spaced apart locations, prior to completely collapsing the casing 6.

The articulating arm 38 provides a longitudinal arm portion 52 and a transverse or cross arm portion 54. The longitudinal portion 52 mounts to the body 55 of the compression assembly 8 at a pivot pin 56. The opposite end of the longitudinal arm 52 mates with the transverse arm 54 at a second pivot point 58. Mounted adjacent the coupling of the articulating arm portions 52, 54 is a pin 60 and bias spring housing 62. The pin 60 contacts the transverse arm 54 to bias it toward an orthogonal relationship to the longitudinal arm 52. The end of the transverse arm 54 otherwise is radiused to rotate relative to the spring housing 62 and an end spacer 64 secured with pin 65 between upper and lower laminated arm plates 66 and 68. The thickness of the cross arm 54 is substantially the same as the spacer 64. The thickness of the arm plates 66 and 68 and arm 54 are sized to meet the intended load. Stiffeners (not shown) can be added to provide additional arm strength. Edge mounted plates 70 are also welded between the plates 66 and 68.

Although not shown in detail, it is to be appreciated that the framing of the compression body 55 and the articulating and stationary arms 38 and 40 are constructed from steels of appropriate size and strength to accommodate the compression pressures. In particular, high tensile strength, T-1 steel is used throughout the assemblies 2 and 4. The overall size of the compression assembly 8 is approximately 7 feet long and 3 to 4 feet wide. Each arm 38 and 40 is approximately 14 inches wide and a 20 inch space is provided between the arms which is sufficient to accommodate a 15-inch compression ram 80.

A hydraulic cylinder 48 extends between the longitudinal arm 52 and the body 55 and is operable under remote control to rotate the longitudinal arm 52 relative to the pivot pin 56, into and out of parallel relation with the stationary arm 40. When rotated outward, the transverse cross arm 54 is drawn away from the stationary arm 40 which exposes the full width of the slot portion 36. The guideplate 30 can then be aligned with the casing 6. Once the compression assembly 8 has been aligned and the casing 6 is brought to bear against the compression die 10, the cylinder 48 is engaged to rotate the articulating arm portions 52, 54 into alignment with the stationary arm 40. This action also induces the transverse arm 54 into abutment with the edge mounted plate 70 of the stationary arm 40.

As the transverse arm 54 abuts the stationary arm 40, a projection 72 at the distal end of the arm 54 is brought into engagement with a chamfered surface 74 of an end stop spacer member 76 which is secured at a pin 77 between the plates 66, 68 of the stationary arm 40. The engagement of the projection 72 and stop 76 and the expansion of the cylinder 48 stabilize the stationary die 12, which is rigidly fastened to the inner surface of the transverse arm 54. The movable compression die 10 is secured to the forward face of the ram cylinder 80. The die 10 and 12 provide a half-moon radiused surface over their full width. However, as discussed above other surface shapes may be used with advantage.

Once the wellhead casing is encircled by the arms and clamped between the dies 10 and 12, the extension of the ram cylinder 80 produces a collapsing action on the casing sidewalls. Depending upon the diameter, wall thickness, and hardness of the casing material, the casing walls eventually collapse onto each other to form internal seam. This seam may be sealed permanently by welding. Depending upon the hardness of the casing, it may be necessary to progressively readjust the vertical gripping position of the die to facilitate the collapsing action. Such readjustment can also prevent a splitting or side wall rupture in the region of the collapsing activity.

In normal practice and once the casing 6 is fully collapsed, appropriate welding equipment is brought to bear to weld the seam formed between the mating pipe. Pressure is maintained on the ram 80 until the welding is completed to assure that the casing 6 does not prematurely re-open. Otherwise, once the casing is welded closed, the well operators can take further steps to return the well to a production status, for example, by mounting gate valves etc. to the casing 6.

Figure 6:
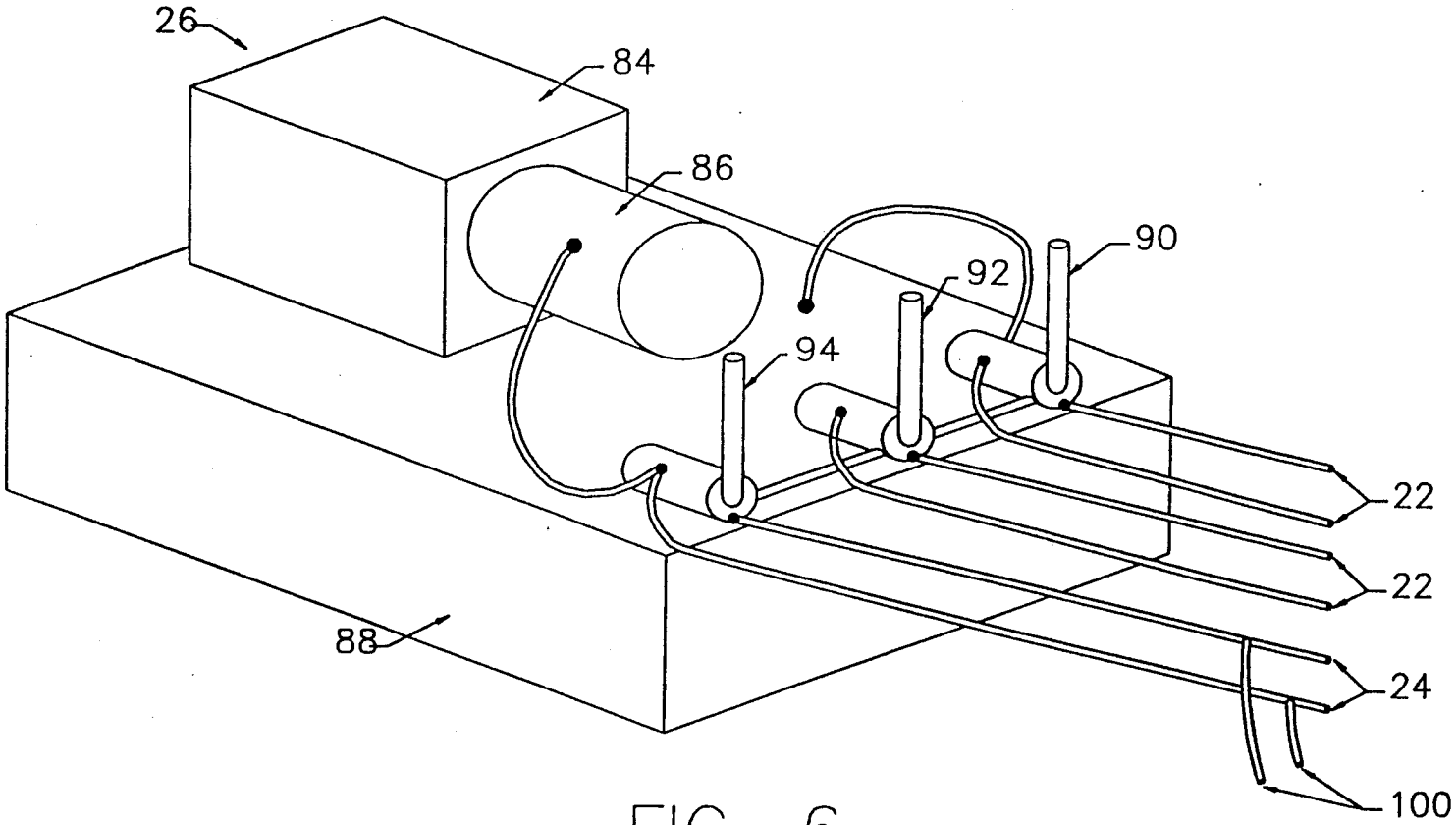
FIG. 6 is a generalized perspective drawing of the remotely mounted hydraulic controller assembly.

With attention next to FIG. 6, a generalized perspective drawing is shown of the makeup of the remote hydraulic controller 26. The controller 26 provides a gas engine 84 and powered pump 86 which draws fluid from a hydraulic fluid reservoir 88 and pressurizes the hydraulic system. The hydraulic fluids are appropriately directed to three hand valves 90, 92, and 94 which supply fluid to the compression assembly 8. The control valve 90 controls right steering, while the control valve 92 controls left steering and the valve 94 controls the actuation of the ram 80. Appropriate lengths of hydraulic hosing 22 and 24 extend from the controller 26 to the compression assembly 8. From FIG. 1, it is to be appreciated that the supply line to the ram cylinder 80 first mounts to a restrictor valve 96 on the input side to the cylinder 80. The restrictor valve 96 prevents the ram cylinder 80 from operating until a pressure on the order of approximately 2,000 pounds is achieved. Prior to the development of that pressure, the arm cylinder 48 operates to open and close the die 10 and 12 around the casing 6.

A further restrictor valve 98 and separate set of control lines 100 can be included at the aft cylinder 50 to prevent the engagement of the cylinder 50 until necessary to open the slot 36 to accomodate the expansion of the casing 6. Typically, the valve 98 would not open until a pressure in the range of 4,000 to 5,000 psi had been obtained.

The ram 80, otherwise, is capable of operating at pressures in the range of 6,000 psi, and for a ram diameter of approximately 15 inches, a compression force of approximately 450 tons of pressure which is brought to bear against the casing contacting surfaces of the dies 10 and 12. Such pressures have been found sufficient to collapse the casing 6, irrespective of the liquid pressure. Larger or smaller pressures may be required depending upon the casing parameters and or the construction of the dies 10 and 12.

While the invention has been described with respect to a presently preferred construction and considered modifications and improvements thereto, it is to be appreciated that still other constructions may suggest themselves to those skilled in the art. Accordingly, it is contemplated that the following claims should be interpreted to include all those equivalent embodiments within the spirit and scope thereof.

What is claimed is:

1. A method for controlling a wellhead fire comprising:

a) remotely guiding means for compressing a wellhead casing into alignment with the casing, wherein the compressing means includes a plurality of articulating clamp arms, compression dies, and a hydraulic cylinder;

b) manipulating said clamp arms to encircle said casing and interlocking said clamp arms to prevent release until withdrawal from the casing;

c) drawing the compression dies into engagement with said wellhead casing; and e) extending the hydraulic cylinder to compress walls of the wellhead casing in a region of said compression dies, whereby opposite interior surfaces of the casing walls are collapsed on each other.

2. A method as set forth in claim 1 further including the step of expanding an alignment guide supporting said compressing means as the wellhead casing is compressed.

3. Apparatus for containing a wellhead fire comprising:

a) means for compressing walls of a wellhead casing onto themselves to seal the casing including:

1) a framework including a stationary arm extending from a body and an articulating arm having a longitudinal section pivotally mounted to said body and a transverse section pivotally mounted to the longitudinal section, 2) means for interlocking the longitudinal and transverse sections to the stationary arm to prevent separation while compressing the wellhead casing, 3) a hydraulic cylinder, 4) first and second compression dies respectively secured to said cylinder and said transverse section, 5) means for expanding the longitudinal and transverse sections to receive the wellhead casing between the articulating and stationary arms and contracting the longitudinal and transverse sections to encircle and clamp the wellhead casing therebetween, and 6) means for extending said cylinder to compress said wellhead casing between said first and second dies and to collapse the walls of the wellhead casing onto themselves;

b) means including a tapered channelway for guiding the compressing means into alignment with the wellhead casing; and c) transport means for supporting the compressing means and the guiding means and for remotely directing the compressing means into engagement with the wellhead casing.

4. Apparatus as set forth in claim 3 wherein the transport means comprises skid means including a plurality of drag cables and winch means for controllably steering said skid means.

5. Apparatus as set forth in claim 3 wherein the transport means comprises a tracked vehicle having a U-shaped chassis and means for remotely steering said vehicle.

6. Apparatus as set forth in claim 3 further including a first cylinder coupled between the longitudinal section and the body for pivoting the articulating arm.

7. Apparatus as set forth in claim 6 further including means for orthogonally biasing the transverse section relative to the longitudinal section.

8. Apparatus as set forth in claim 7 wherein the transverse section includes a projection and said stationary section includes an end stop having a surface mating with the projection and wherein said end stop and said projection interlock to prevent separation of the stationary and articulating arms during compression.

9. Apparatus as set forth in claim 6 wherein said guiding means is comprised of first and second portions, wherein said body and said stationary arm are secured to one portion and said articulating arm is pivotally secured to the other portion and wherein a second cylinder is coupled between said first and second portions for pivoting the first and second portions to expand the channelway as the wellhead casing is compressed.

10. Apparatus as set forth in claim 9 further including means for preventing an extension of said second cylinder until said first cylinder induces said articulating and stationary arms to encircle the wellhead casing.

11. Apparatus as set forth in claim 10 further including means for preventing an extension of said second cylinder until said wellhead casing has collapsed to substantially occupy a width of said channelway.

12. Apparatus as set forth in claim 3 wherein said first and second compression dies are secured between sections of plate steel which comprise said stationary and articulating arms.

13. Apparatus as set forth in claim 3 wherein surfaces of said first and second compression dies which contact the wellhead casing exhibit a semicircular contour when viewed in side profile.

14. Apparatus for collapsing walls of a wellhead casing to seal-off a bore of the casing and thereby suppress a wellhead fire including:

a) a framework including a stationary arm extending from a body and having an end stop and an articulating arm having a longitudinal section pivotally mounted to said body and a transverse section pivotally mounted to the longitudinal section and means for orthogonally biasing said longitudinal and transverse sections relative to each other and wherein said transverse section includes a surface projection which engages a complementary surface of said end stop;

b) a hydraulic cylinder;

c) first and second compression dies respectively secured to said cylinder and said transverse section;

d) means for expanding the longitudinal and transverse sections to receive the wellhead casing between the articulating and stationary arms and contracting the longitudinal and transverse sections to encircle and clamp the wellhead casing between the articulating and stationary arms and the body; and e) means for extending said cylinder to compress said wellhead casing between said first and second dies and to collapse the walls of the casing onto themselves.

* * * * *